United States Patent [19]

Sauer et al.

[11] 4,257,081

[45] Mar. 17, 1981

[54] CIRCUIT ARRANGEMENT FOR THE CONTROL OF A BISTABLE RELAY

[75] Inventors: Hans Sauer, Deisenhofen; Wolf Steinbichler, Bad Feilnbach; Heinz Ritter, Schongau; Sepp Antonitsch, Otterfing, all of Fed. Rep. of Germany

[73] Assignees: Matsushita Electric Works Ltd., Tokyo, Japan; SDS-Electro GmbH, Deisenhofen, Fed. Rep. of Germany

[21] Appl. No.: 952,926

[22] Filed: Oct. 19, 1978

[30] Foreign Application Priority Data

Oct. 24, 1977 [DE] Fed. Rep. of Germany ..... 2747607

[51] Int. Cl.[3] ..... H01H 47/32

[52] U.S. Cl. ..... 361/156; 361/205; 361/208

[58] Field of Search ..... 361/155, 156, 187, 205, 361/208

[56] References Cited

U.S. PATENT DOCUMENTS

| | | | |
|---|---|---|---|
| 3,064,165 | 11/1962 | Kennedy | 361/155 |
| 3,460,000 | 8/1969 | Kiffmeyer | 361/205 X |
| 3,544,849 | 12/1970 | Speaker | 361/205 X |
| 3,946,287 | 3/1976 | Hopkins | 361/205 X |
| 4,138,708 | 2/1979 | Takeshima | 361/156 |

FOREIGN PATENT DOCUMENTS

| | | | |
|---|---|---|---|
| 2511564 | 9/1976 | Fed. Rep. of Germany | 361/205 |

*Primary Examiner*—Harry E. Moose, Jr.
*Attorney, Agent, or Firm*—Thomas E. Beall, Jr.

[57] ABSTRACT

Circuit arrangements for the control of a bistable relay having a capacitor connected in series with its excitation winding, in which the series connection of coil and capacitor is connected to excitation voltage for the excitation of the relay and simultaneous charging of the capacitor, and, upon absence of excitation voltage, is short-circuitable through a semiconductor switch having its output circuit parallel-connected with the series connection of coil and capacitor, whereby the relay switches back to its starting position.

22 Claims, 4 Drawing Figures

CIRCUIT ARRANGEMENT FOR THE CONTROL OF A BISTABLE RELAY

BACKGROUND OF THE INVENTION

A circuit arrangement for the switching-over of a bistable relay with the aid of a semiconductor is, for example, known from the book "Relais Lexikon" (Relay Lexicon) by H. Sauer, first edition, 1975, page 12. Upon application of the excitation voltage, a first transistor connected in series with the coil and capacitor is conductive, the relay actuates and the capacitor is charged. If a positive control signal is provided at the input of a second transistor, then the first transistor is blocked and a third transistor, connected in parallel to the coil and capacitor, conducts. The capacitor is discharged through this third transistor and the relay switches back. If the control signal jumps to zero value, then the second and third transistors are again blocked, the first transistor is conductive and the capacitor is again charged, with which the relay switches over.

A circuit arrangement of this type is expedient for this operation of bistable relays when the polarity of the excitation voltage remains unchanged. The relay remains in its switched position after charging of the capacitor, independent of whether the excitation voltage is switched off or is applied as before. A diode connected in series prevents a slow discharge of the capacitor when the excitation voltage is absent. The relay is switched back only by a positive control pulse at the input of the second transistor. When this pulse cannot be produced from the excitation voltage, such as when the excitation voltage is switched off, the necessity for an external control signal source results.

In addition to this, a circuit arrangement for the controlling of a bistable relay is known from German Published Patent Application No. 2 624 913, in which this this circuit arrangement acts as a monostable relay and thus switches back automatically to the starting position upon insufficiency of the excitation voltage. This is attained in that an evaluation circuit fed with the excitation voltage is connected, on the one hand, and the control electrode of the semiconductor, on the other hand, the evaluation circuit blocking the semiconductor when the excitation voltage is present and rendering the semiconductor conductive when such voltage is absent. For the prevention of an unintended discharge of the capacitor, a diode is also connected in the current path. A series resistance in the same path serves for short-circuit-proofing of the semiconductor as well as for corresponding dimensioning for the realization of a defined voltage drop, with which a relay with economically-fabricatable low-voltage windings may be operated with higher voltages such as, for example, line voltage. With this, however, an evaluation circuit required to achieve the monostable switch operation of the relay leads to a relatively high expenditure of components.

SUMMARY OF THE INVENTION

The invention has as its object to construct a circuit arrangement of the afore-mentioned type, such that upon dropout of the excitation voltage a desired automatic switching-over of the bistable relay is realizable as with the known arrangement, but with reduced expenditure of components.

According to the invention, this object is attained in that the input circuit of the semiconductor is parallel connected to a resistance element in series with the excitation coil and capacitor and in that after complete charging of the capacitor and switching off of the excitation voltage, a voltage drop appearing across the resistance element causes the semiconductor to be conductive.

Through these measures it results that the evaluation circuit required by the known arrangement is entirely saved and therewith an especially simple arrangement which can be constructed to save space is produced. In the simplest case, an ohmic resistance can be provided as resistance element, however, preferably an element with non-linear characteristic, for example, a diode connected to the excitation voltage in the conductive direction, can be used, because then the voltage loading of the input circuit of the semiconductor is limited, for example, to the value of the threshold voltage of the diode; the charging current of the capacitor, however, remains nearly unaffected.

THE PREFERRED EMBODIMENTS

Figure 1:
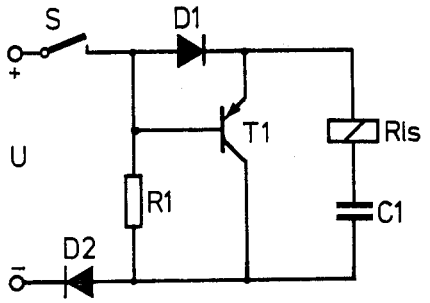
FIG. 1 shows a circuit arrangement with a diode as resistance element, connected in parallel to the base-emitter span of a transistor.

With the arrangement represented in FIG. 1, an ohmic resistance R1 is connected in parallel to the terminals of the excitation voltage U and is connected with one of its terminals to the diode D1 which serves as resistance element coupled in the conducting direction to the excitation voltage U. A transistor T1, as semiconductor switch, is coupled with its base electrode to the connection point of diode D1 and ohmic resistance R1 and at its output side to the terminals of diode D1 and the ohmic resistance R1 which are not mutually connected.

The excitation voltage is applied by closing of switch S, in the course of which the relay R1s is energized by the charging current of capacitor C1. Transistor T1 is loaded at its input side at the value of the threshold voltage of diode D1 in the blocking direction and is thus blocked. After complete charging of capacitor C1, the only current which flows is that for providing additional charge to the capacitor as well as a required limited current through the base resistor R1. If the switch S is now opened or the excitation voltage switched off, the diode D1 blocks so the emitter electrode of the transistor T1 is positive with respect to its base electrode. Transistor T1 is thereby rendered conductive so that the capacitor C1 can discharge through the excitation coil R1s of the relay. Through this, the bistable relay switches back to its original position. With monostable switch operation, the present arrangement takes energy from the excitation voltage source, apart from the leakage in the base resistor R1 and capacitor C1, only for the charging of capacitor C1. The small expenditure of construction elements further makes possible an economical and space-saving structure. The entire arrangement is preferably housed in the housing provided for the relay.

In place of the diode D1, an ohmic resistance can, in principle, also be utilized as resistance element. Diode D1 offers security, however, against a slow discharge of capacitor C1. In addition, the diode limits the voltage drop at the input portion of transistor T1 during the charging of the capacitor to the diode's threshold voltage, and thereby also limits the voltage to a harmless level. The excitation voltage U will, in addition, be reduced to the threshold voltage of diode D1 for the charging of capacitor C1. Diode D2 serves for protection of transistor T1 against false polarity of the excitation voltage U.

Figure 2:
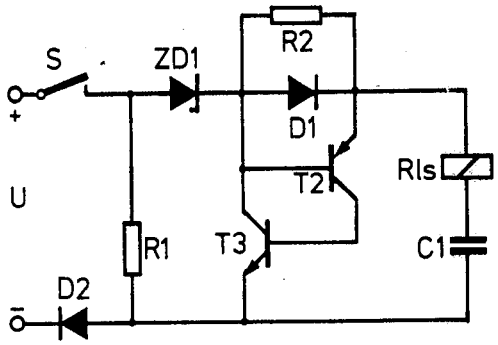
FIG. 2 shows a circuit arrangement with defined deenergizing voltage.

With the arrangement shown in FIG. 2, a Zener diode ZD1 is connected in series with diode D1 in the conductive direction with respect to the excitation voltage U. Diode D1 is by-passed by an ohmic resistance R2 and a semiconductor trigger switch stage is provided which consists of two transistors T2, T3 of opposite conductivity type. The collector electrode of each transistor is coupled respectively with the base electrode of the other transistor. A defined value for the deenergization voltage of the relay is established by the Zener voltage in this embodiment. The deenergization voltage results from the difference between the excitation voltage and the Zener voltage $U_{ZD1}$. When the excitation voltage U is switched on by the switch S, the charging current for the capacitor C1 flows through the Zener diode ZD1, diode D1 and the excitation coil R1s. The relay is hereby excited and switches over. Voltage drops appear once again across the diodes ZD1 and D1 in the value of their threshold voltages. The pnp-transistor T2 is thereby blocked, as has already been described for the arrangement of FIG. 1. Accordingly, the npn-transistor T3 is also blocked.

After the complete charging of the capacitor C1, the current flow again essentially reduces itself to the additional charging of the capacitor and to a current through resistor R1. This residual current can with this embodiment be held essentially smaller than in the case of FIG. 1, because the base resistor R1, as a result of the higher total amplification of the trigger stage constructed of transistors T1, T2, can be dimensioned somewhat larger. Through the resistor R2, the same potential develops at the anode and cathode of diode D1, whereby the blocking of the trigger stage T2, T3 remains ensured.

If the excitation voltage U now declines somewhat, then the potential appearing at the cathode of the Zener diode UD1 will be essentially maintained, bacause the Zener diode ZD1 is loaded in the blocking direction. Only if the excitation voltage U declines so much that the voltage drop across the zener diode ZD1 reaches the Zener voltage $U_{ZD1}$ will the Zener diode be conductive. Transistor T2 will now be forward biased by the voltage drop appearing across diode D1 and resistor R2, its base current can now flow over Zener diode ZD1 and the ohmic resistor R1, and therewith also the complementary transistor T3 is forward biased. The capacitor C1 now discharges itself through the excitation coil R1s, whereby the relay is switched back to its original position.

Besides the advantage with respect to the circuit of FIG. 1 of a reduced leakage current, it results with the circuit of FIG. 2, through the realization of a defined deenergizing voltage, that variations in the excitation voltage U can be permitted between the maximum value of the excitation voltage and the value of the deenergizating voltage, without resulting in an unintended switching-over of the relay.

Figure 3:
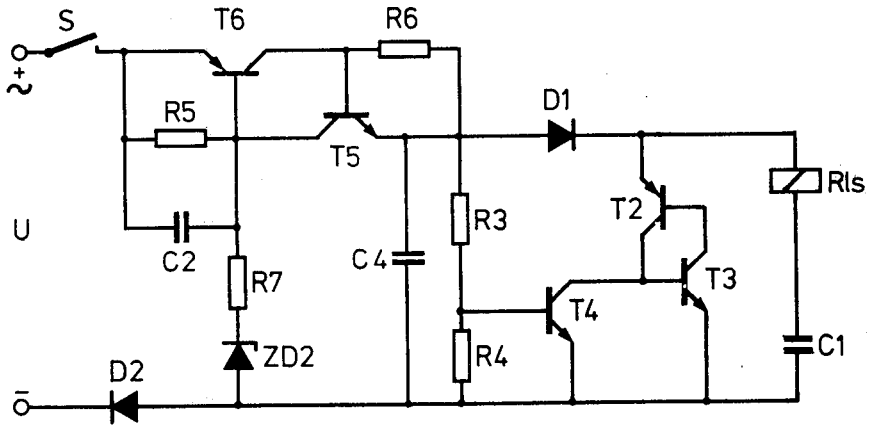
FIGS. 3 and 4 show arrangements with fixed operating and deenergizing voltages for the relays utilized.

As FIG. 3 shows, a defined deenergizing voltage allows itself, however, also to be attained with a voltage divider consisting of two ohmic resistors (R3, R4) connected in parallel to the terminals of the excitation voltage U. One of the divider resistors (R3) is connected with the anode of diode D1, which lies at the excitation voltage U. The semiconductor switch is coupled with its control electrode to the center tap of the voltage divider R3, R4 and, at its output side, is connected to the terminals of the resistance element turned away from the divider resistor R3 and the other divider resistor R4. The deenergization voltage of the relay is established in this case by the relationship between the divider resistors R3, R4. The switch, a trigger stage constructed of complementary transistors T2, T3, having respectively the collector electrode of each trigger stage transistor coupled to the base electrode of the other trigger stage transistor and in which the emitter electrode of the one transistor T2 is connected to the cathode of diode D1 and the emitter electrode of the other transistor T3 is coupled to the common lower terminal of the circuit arrangement, will be conductive after the complete charging of the capacitor C1 in the manner already described, when the excitation voltage U has declined to the value of the desired de-energization voltage. For the defined establishment of the switching point and for the prevention of unintended switching-through of the trigger stage upon the occurrence of voltage peaks, a further npn-transistor T4 is connected in series with the trigger stage transistor in such manner that its collector electrode is coupled to the base electrode of the trigger stage transistor T3, its base electrode is coupled to the center tap of the voltage divider R3, R4, and its emitter electrode is coupled to the common lower terminal of the circuit arrangement.

Also in order to obtain a defined operating voltage, it is provided that the diode D1 serving as resistance element is connected in series with a further trigger stage constructed of complementary transistors T5, T6 and that a reference voltage is provided at the base electrode of the first trigger stage transistor T6 in such manner that the trigger stage is only rendered conductive when the excitation voltage U exceeds the value of the reference voltage. The reference voltage thereby predetermines the desired operating voltage. As soon as the excitation voltage U exceeds the reference voltage, the trigger stage T5, T6 is conductive. The charging current of capacitor C1 can now flow through the diode D1 and the excitation coil R1s so that the relay operates when the excitation voltage U falls below the reference voltage, then the trigger stage T5, T6 blocks. For the realization of the reference voltage, the series connection of an ohmic resistor R7 and a Zener diode ZD2 in the blocking direction with respect to the polarity of the excitation voltage is connected between the base electrode of the first transistor T6 and the common ground potential of the circuit arrangement.

In order to ensure that the residual currents of the transistors T5, T6 are maintained small and an unintended switching-over of the trigger stage is avoided, the base-emitter spans of the transistors T5, T6 are bridged with ohmic resistors R6, R5, respectively. The capacitor C2 between base and emitter electrodes of transistor T6 is provided in order to prevent the trigger stage T5, T6 from switching through too early upon switching-on of the excitation voltage U.

In order that the circuit arrangement may also be operated with alternating current, a rectifier diode D2 is connected in the circuit. With direct current operation, this rectifier diode serves as protection against false polarity. In addition, a capacitor C4 is arranged in the input circuit of the semiconductor switch T4, T3, T2, having a capacity selected sufficiently large that the resulting discharge constant is greater than the time duration of the voltage troughs caused by the rectification.

Figure 4:
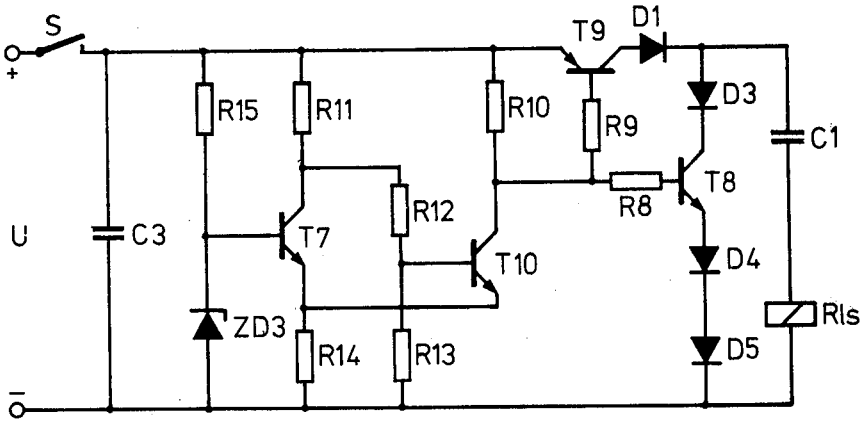

With the embodiment according to FIG. 4, diode D1, is connected in series with a further semiconductor switch which is of complementary conductivity type to the first semiconductor switch lying in parallel to the series connection of excitation coil R1s and capacitor C1. Furthermore, a voltage divider is connected between the terminals of the excitation voltage U, control electrodes of the semiconductor switch being coupled to a tap of the voltage divider for alternating control thereof. The potential at the tap of the voltage divider is so selected that upon application of excitation voltage U, the further semiconductor switch conducts, so that the charging current of capacitor C1 flows through the diode D1 and the excitation coil Rls while the first semiconductor switch is blocked. Upon the absence of excitation voltage U, the further semiconductor switch is blocked and the first is conductive, in the course of which the capacitor discharges in the manner already described.

In particular, an npn-transistor T8 is provided as the first semiconductor switch and a pnp-transistor T9 is provided as second semiconductor switch in FIG. 4. The collector terminal of the npn-transistor T8 is connected with the cathode of diode D1, through diode D3 while the emitter of this transistor is connected with the common ground potential of this circuit arrangement. The pnp-transistor T9 is coupled with its collector electrode to the anode of diode D1 and with its emitter electrode to a terminal of the excitation voltage U. The voltage divider consists of an ohmic resistor R10 as well as a further resistance connected between the tap and the common ground potential. Both transistors T8, T9 have their base terminals connected with the tap of the voltage divider, and ohmic resistors R8, R9 are coupled respectively between the tap of the voltage divider and the base electrode of the transistors T8, T9.

The further resistance of the voltage divider not illustrated in FIG. 4 is formed by the output circuit of a Schmitt-trigger T7, T10 fed with the excitation voltage U. A reference voltage derived from the excitation voltage U is provided at the input of this Schmitt-trigger such that the switch-over points of the Schmitt-trigger determine the actuation or, respectively, deenergization voltage of the relay.

In order that the emitter potential of the transistor T8 clearly lies above its collector potential with transistor T10 conductive, and thus transistor T8 securely blocks, two diodes D4, D5 are connected in the conductive direction between the emitter electrode of T8 and ground potential. A diode D3 in the collector lead wire of transistor T8 prevents an unintended, gradual charging of capacitor C1 through the resistors R10, R8.

With slowly increasing excitation voltage U, the transistor T7 is first of all forward-biased; thus, the transistor T10 blocks. The common voltage divider tap has more positive potential than the emitter electrode of the transistor T8, such that this transistor is conductive and T9 is blocked. It is thus ensured that the capacitor C1 is discharged.

If as a result of increasing excitation voltage U the sum of the base-emitter voltage of transistor T7 and the voltage drop across resistor R14 exceeds the Zener voltage $U_{ZD3}$ at the base electrode of T7, then the transistor T7 will be blocked and transistor T10 will be conductive. At this first switch-over point of the Schmitt-trigger, the common voltage divider tap receives a more negative potential than the emitter electrodes of transistors T8, T9, in the course of which T9 will be conductive and T8 will be blocked. Now the charging current of capacitor C1 flows and the relay is excited.

With decreasing excitation voltage U, the second switch-over point of the Schmitt-trigger will be reached when the sum of the voltage drops across the base-emitter span of transistor T7 and across resistor R7 falls below the Zener voltage UD3. Now again transistor T7 is conductive and transistor T10 is blocked. This has the consequence that transistor T9 is blocked and transistor T8 is conductive, whereby the condensor C1 is discharged and the relay switches back.

The capacitor C3 at the input of the circuit arrangement guarantees acceptable switching of the Schmitt-trigger even if excitation voltage U, when switched on, has a steep leading edge. Besides, through selection of the Zener voltage $U_{ZD3}$, the switch-over points of the trigger and therewith the operating and deenergization voltage of the relay can be exactly established even with creeping excitation voltage of the Schmitt-trigger.

What is claimed is:

1. A control circuit arrangement, comprising:

a bistable relay having an excitation coil for energizing the relay between first and second positions;

a capacitor having a storage capacity sufficient to energize said relay;

circuit means coupling said capacitor in series with said coil for providing all the current flow through said coil from said capacitor during charging and for blocking all current flow through said coil by said capacitor when said capacitor is charged;

a resistance element coupled in series with said series-coupled capacitor and coil;

an excitation voltage source coupled in parallel with said series-coupled coil, capacitor, and resistance element; and a semiconductor switch means having a controlling electrode coupled to detect the voltage drop across said resistance element, and having outputs coupled in parallel across said series-coupled coil and capacitor, so that when the voltage from said source exceeds a first predetermined level, current flows through said resistance element and said coil to switch said relay to its first position and simultaneously charge said condensor to a voltage substantially equal to that of the source, said semiconductor switch means being thereby rendered non-conductive, and when said capacitor is charged and the voltage from said source drops to a second predetermined level, the reduced voltage drop across said resistance element renders said semiconductor switch means conductive, allowing said capacitor to discharge through said coil to switch said relay to its second position.

2. The circuit arrangement of claim 1, further comprising an ohmic resistance coupled in parallel across said excitation voltage source and having a first terminal coupled to a first terminal of said resistance element, said semiconductor switch means having its controlling electrode coupled to the junction of said resistance element and said ohmic resistance and having its output electrodes connected respectively to a second terminal of said ohmic resistance and a second terminal of said resistance element.

3. The circuit arrangement of claim 2, wherein said resistance element comprises a diode coupled in the conductive direction with respect to the polarity of said excitation voltage source, and said semiconductor switch comprises a transistor having its emitter electrode coupled to the cathode of said diode.

4. The circuit arrangement of claim 1, wherein said resistance element comprises a first diode coupled in the conductive direction with respect to the polarity of said energization voltage, the arrangement further comprising a Zener diode coupled in series with said first diode in the conductive direction with respect to the polarity of said excitation voltage and a first ohmic resistance coupled in parallel across said excitation voltage source and having a first terminal coupled to the anode of said Zener diode, said semiconductor switch means having its controlling electrode coupled to the junction of said first diode with the cathode of said Zener diode and having its output electrodes coupled respectively to the cathode of said first diode and to a second terminal of said first ohmic resistance, whereby when said capacitor is charged, the difference between the voltage across said charged capacitor and the Zener voltage of said Zener diode establishes said second predetermined source voltage level.

5. The circuit arrangement of claim 4, further comprising a second ohmic resistance coupled in parallel across said first diode, said semiconductor switch means comprising a trigger stage having two transistors of opposite conductivity type, the first said transistor having its base electrode coupled to the junction of said Zener diode with said first diode and to the collector electrode of the second said transistor, having its collector electrode coupled to the base of said second transistor, and having its emitter electrode coupled to the cathode of said first diode, and the second said transistor having its emitter coupled to said second terminal of said first ohmic resistance.

6. The circuit arrangement of claim 1, wherein said resistance element has a first terminal coupled to receive said excitation voltage and a second terminal coupled to said series-coupled coil and capacitor, said arrangement further comprising a voltage divider having series-connected first and second ohmic resistances coupled in parallel across said excitation voltage source, respective first terminals of said ohmic resistances being joined together, to form a voltage-divider tap, a second terminal of said first ohmic resistance being coupled to said first resistance element terminal, and said semiconductor switch means having it controlling electrode coupled to said voltage-divider tap, having a first output coupled to the second terminal of said resistance element, and having a second output coupled to a second terminal of said second ohmic resistance.

7. The circuit arrangement of claim 6, wherein said resistance element comprises a first diode coupled in the conductive direction with respect to the polarity of the energization voltage, and said semiconductor switch means comprises a trigger stage having first and second transistors of opposite conductivity type, each said transistor having its collector electrode coupled to the base electrode of the other said transistor, said first transistor having its emitter electrode coupled to the cathode of said first diode, and said second transistor having its emitter electrode coupled to said second terminal of said second ohmic resistance.

8. The circuit arrangement of claim 7, wherein said semiconductor switch means further comprises a third transistor having its collector electrode coupled to the base electrode of said second transistor, its base electrode coupled to said voltage-divider tap, and its emitter electrode coupled to said second terminal of said second ohmic resistor.

9. The circuit arrangement of claim 1, further comprising a trigger stage coupled in series between aid excitation voltage source and said resistance element for providing said excitation voltage to said resistance element when said excitation voltage exceeds a predetermined reference voltage, and means for providing said predetermined reference voltage to said trigger stage.

10. The circuit arrangement of claim 9, wherein said trigger stage comprises first and second transistors of opposite conductivity type, a further capacitor, and first and second ohmic resistors, the collector of each said transistor being coupled to the base of the other said transistor, said first ohmic resistor being coupled between the base and emitter electrodes of said first transistor, said second ohmic resistor being coupled between the base and emitter electrodes of said second transistor, said further capacitor being coupled in parallel across said first ohmic resistor, the emitter electrode of said first transistor being coupled to receive said excitation voltage, the emitter of said second transitor being coupled to a terminal of said resistance element, and said predetermined reference voltage being supplied to the base of said first transistor.

11. The circuit arrangement of claim 9, wherein said means for providing said predetermined reference voltage comprises a third ohmic resistance and a Zener diode coupled in series across said excitation voltage source, said Zener diode being coupled in the blocking direction with respect to the polarity of said excitation voltage source.

12. The circuit arrangement of claim 1, further comprising an additional semiconductor switch means coupled in series between said resistance element and said excitation voltage source, said additional semiconductor switch means having a controlling electrode and being opposite in conductivity type from said first-mentioned semiconductor switch means and a voltage divider coupled across the terminals of said excitation voltage source and having a voltage tap, the respective controlling electrodes of said semiconductor switch means being coupled, for alternating complementary control of said semiconductor switch means, to said voltage divider tap.

13. The circuit arrangement of claim 12, wherein said resistance element comprises a diode coupled in the conductive direction with respect to the polarity of said excitation voltage, said first-mentioned semiconductor switch means comprises an npn-transistor, said additional semiconductor switch means comprises a pnp-transistor, said pnp-transistor having its collector electrode coupled to the cathode of said diode, having its emitter electrode coupled to a first terminal of said excitation voltage source, and having its base electrode coupled to said voltage-divider tap, said pnp-transistor having its collector electrode coupled to the anode of said diode, having its emitter electrode coupled to a second terminal of said excitation voltage source, and having its base electrode coupled to said voltage-divider tap, and wherein said voltage divider comprises an ohmic resistance coupled between said voltage-divider tap and said second excitation voltage source terminal and a further resistance element coupled between said voltage-divider tap and said first excitation voltage source terminal.

14. The circuit arrangement of claim 13, further comprising a respective ohmic resistance coupled between said voltage-divider tap and the base electrode of each said transistor.

15. The circuit arrangement of claim 13, wherein said further resistance element comprises a Schmitt-trigger circuit, said Schmitt-trigger circuit being supplied with a reference voltage derived from said excitation voltage, and wherein the switch-over points of said Schmitt-trigger circuit determine respectively said first and second predetermined source voltage levels.

16. The circuit arrangement of claim 1, wherein said excitation voltage source provides alternating current, the arrangement further including a diode coupled in series with said source for rectifying the excitation voltage, and a capacitor coupled in parallel across said excitation voltage source, the capacity of said further capacitor being sufficiently large that its discharge time constant is greater than the time duration of the voltage troughs caused by the rectification.

17. A circuit arrangement for the control of a bistable relay having an excitation coil, comprising:

a capacitor coupled in series with said coil;

a resistance element coupled in series with said series-coupled capacitor and coil;

an excitation voltage source coupled in parallel with said series-coupled coil, capacitor, and resistance element;

a semiconductor switch having a controlling electrode coupled to detect the voltage drop across said resistance element, and having outputs coupled in parallel across said series-coupled coil and capacitor, whereby when the voltage from said source exceeds a first predetermined level, current flows through said resistance element and said coil to switch said relay to its first position and simultaneously charge said capacitor, said semiconductor switch being thereby rendered non-conductive, and when said capacitor is charged and the voltage from said source drops to a second predetermined level, the reduced voltage drop across said resistance element renders said semiconductor switch conductive, allowing said capacitor to discharge through said coil to switch said relay to its second position;

an additional semiconductor switch means coupled in series between said resistance element and said excitation voltage source, said additional semiconductor switch means having a controlling electrode and being opposite in conductivity type from said first-mentioned semiconductor switch means; and a voltage-divider coupled across the terminals of said excitation voltage source and having a voltage tap, the respective controlling electrodes of said semiconductor switch means being coupled, for alternating complementary control of said semiconductor switch means to said voltage-divider tap.

18. The circuit arrangement of claim 17, wherein said resistance element comprises a diode coupled in the conductive direction with respect to the polarity of said excitation voltage, said first-mentioned semiconductor switch means comprises an npn-transistor, said additional semiconductor switch means comprises a pnp-transistor, said npn-transistor having its collector electrode coupled to the cathode of said diode, having its emitter electrode coupled to a first terminal of said excitation voltage source, and having its base electrode coupled to said voltage-divider tap, said pnp-transistor having its collector electrode coupled to the anode of said diode, having its emitter electrode coupled to a second terminal of said excitation voltage source, and having its base electrode coupled to said voltage-divider tap, and wherein said voltage divider comprises an ohmic resistance coupled between said voltage-divider tap and said second excitation voltage source terminal and a further resistance element coupled between said voltage-divider tap and said first exciation voltage source terminal.

19. The circuit arrangement of claim 18, further comprising a respective ohmic resistance coupled between said voltage-divider tap and the base electrode of each said transistor.

20. The circuit arrangement of claim 18, wherein said further resistance element comprises a Schmitt-trigger circuit, said Schmitt-trigger circuit being supplied with a reference voltage derived from said excitation voltage, and wherein the switch-over points of said Schmitt-trigger circuit determine respectively said first and second predetermined source voltage levels.

21. A circuit arrangement for the control of a bistable relay having an excitation coil, comprising:

a capacitor coupled in series with said coil;

a resistance element coupled in series with said series-coupled capacitor and coil;

an excitation voltage source coupled in parallel with said series-coupled coil, capacitor, and resistance element;

a semiconductor switch having a controlling electrode coupled to detect the voltage drop across said resistance element, and having outputs coupled in parallel across said series-coupled coil and capacitor, whereby when the voltage from said source exceeds a first predetermined level, current flows through said resistance element and said coil to switch said relay to its first position and simultaneously charge said capacitor, said semiconductor switch being thereby rendered non-conductive, and when said capacitor is charged and the voltage from said source drops to a second predetermined level, the reduced voltage drop across said resistance element renders said semiconductor switch conductive, allowing said capacitor to discharge through said coil to switch said relay to its second position;

said resistance element having a first terminal coupled to receive said excitation voltage and a second terminal coupled to said series-coupled coil and capacitor;

a voltage-divider having series-connected first and second ohmic resistances coupled in parallel across said excitation voltage source, respective first terminals of said ohmic resistances being joined together, to form a voltage-divider tap, a second terminal of said first ohmic resistance being coupled to said first resistance element terminal, and said semiconductor switch means having its controlling electrode coupled to said voltage-divider tap, having a first output coupled to the second terminal of said resistance element, and having a second output coupled to a second terminal of said ohmic resistance;

said resistance element comprising a first diode coupled in the conductive direction with respect to the polarity of the energization voltage, and said semiconductor switch means comprising a trigger stage having first and second transistors of opposite conductivity type, each said transistor having its collector electrode coupled to the base electrode of the other said transistor, said first transistor having its emitter electrode coupled to the cathode of said first diode, and said second transistor having its emitter electrode coupled to said second terminal of said second ohmic resistance; and said semiconductor switch means further comprising a third transistor having its collector electrode coupled to the base electrode of said second transistor, its base electrode coupled to said voltage-divider tap, and its emitter electrode coupled to said second terminal of said second ohmic resistance.

22. A circuit arrangement for the control of a bistable relay having an excitation coil, comprising:

a capacitor coupled in series with said coil;

a resistance element coupled in series with said series-coupled capacitor and coil;

an excitation voltage source coupled in parallel with said series-coupled coil, capacitor, and resistance element;

a semiconductor switch having a controlling electrode coupled to detect the voltage drop across said resistance element, and having outputs coupled in parallel across said series-coupled coil and capacitor, whereby when the voltage from said source exceeds a first predetermined level, current flows through said resistance element and said coil to switch said relay to its first position and simultaneously charge said capacitor, said semiconductor switch being thereby rendered non-conductive, and when said capacitor is charged and the voltage from said source drops to a second predetermined level, the reduced voltage drop across said resistance element renders said semiconductor switch conductive, allowing said capacitor to discharge through said coil to switch relay to its second position;

a trigger stage coupled in series between said excitation source and said resistance element for providing said excitation voltage to said resistance element when said excitation voltage exceeds a predetermined reference voltage;

means for providing said predetermined reference voltage to said trigger stage;

said trigger stage comprising first and second transistors of opposite conductivity type, a further capacitor, and first and second ohmic resistors, the collector of each said transistor being coupled to the base of the other said transistor, said first ohmic resistor being coupled between the base and emitter electrodes of said first transistor, said second ohmic resistor being coupled between the base and the emitter electrodes of said second transistor, said further capacitor being coupled in parallel across said first ohmic resistor, the emitter electrode of said first transistor being coupled to receive said excitation voltage, the emitter of said second transistor being coupled to a terminal of said resistance element, and said predetermined reference voltage being supplied to the base of said first transistor.

* * * * *